US007391850B2

(12) United States Patent
Kaertner et al.

(10) Patent No.: US 7,391,850 B2
(45) Date of Patent: Jun. 24, 2008

(54) COMPACT, HIGH-FLUX, SHORT-PULSE X-RAY SOURCE

(75) Inventors: Franz X. Kaertner, Newton, MA (US); William S. Graves, Marblehead, MA (US); David E. Moncton, Newton, MA (US); Fatih Omer Ilday, Ankara (TR)

(73) Assignee: Massachusetts Institute of Technology, Cambridge, MA (US)

( * ) Notice: Subject to any disclaimer, the term of this patent is extended or adjusted under 35 U.S.C. 154(b) by 257 days.

(21) Appl. No.: 11/391,085

(22) Filed: Mar. 27, 2006

(65) Prior Publication Data

US 2006/0251217 A1 Nov. 9, 2006

Related U.S. Application Data

(63) Continuation-in-part of application No. 11/277,393, filed on Mar. 24, 2006, now abandoned.

(60) Provisional application No. 60/665,434, filed on Mar. 25, 2005.

(51) Int. Cl.
*H01J 35/00* (2006.01)
*H01J 35/14* (2006.01)

(52) U.S. Cl. ..... 378/118; 378/138

(58) Field of Classification Search ..... 378/119, 378/121, 122, 136–143, 145, 84, 34; 372/5
See application file for complete search history.

(56) References Cited

U.S. PATENT DOCUMENTS 5,495,515 A 2/1996 Imasaki ..... 378/119
5,825,847 A 10/1998 Ruth et al. ..... 378/119
6,035,015 A 3/2000 Ruth et al. ..... 378/119
6,327,335 B1 12/2001 Carroll ..... 378/85
6,332,017 B1 12/2001 Carroll et al. ..... 378/119
6,459,766 B1 10/2002 Srinivasan-Rao ..... 378/119
6,687,333 B2 2/2004 Carroll et al. ..... 378/119
6,724,782 B2 4/2004 Hartemann et al. ..... 372/5
7,016,470 B2 * 3/2006 Lawrence et al. ..... 378/119
7,027,553 B2 * 4/2006 Dunham et al. ..... 378/5
2005/0213708 A1 9/2005 Lawrence et al. ..... 378/119

(Continued)

FOREIGN PATENT DOCUMENTS

GB 2 300 341 A 10/1996

OTHER PUBLICATIONS

Brown et al. *Physical Review Special Topics—Accelerators and Beams*, 7:060702 (2004).

(Continued)

*Primary Examiner*—Irakli Kiknadze
(74) *Attorney, Agent, or Firm*—Robert J. Sayre; Modern Times Legal

(57) ABSTRACT

An x-ray source that can produce high-brilliance x-rays at a low cost and from a small footprint includes a radiofrequency (RF) photoinjector, an accelerator module (such as a linear superconducting accelerator moducle), a high-power optical laser apparatus, and a passive enhancement cavity. A stream of photons generated by the laser apparatus is accumulated in the enhancement cavity, and an electron stream from the photoinjector are then directed through the enhancement cavity to collide with the photons and generate high-brilliance x-rays via inverse-Compton scattering.

35 Claims, 5 Drawing Sheets

U.S. PATENT DOCUMENTS

2005/0271185 A1* 12/2005 Loewen et al. ..... 378/119
2006/0222147 A1* 10/2006 Filkins et al. ..... 378/119

OTHER PUBLICATIONS

Carroll, F. *J. Cell. Biochem*., 90:502-508 (2003).
Edwards eat al. *Rev. Sci. Instrum*., 74(7):3207-3245 (2003).
Farkhondeh et al. *IEEE*, Proceedings of the 2003 Particle Accelerator Conference, pp. 956-958 (2003).
Faure et al. *Nature*, 431:541-544 (2004).
Geddes et al. *Nature*, 431:538-541 (2004).
Jones et al. *Optics Lett*., 27(20):1848-1850 (2002).
Katsouleas, T. *Nature*, 431:515-516 (2004).
Mangles et al. *Nature*, 431:535-538 (2004).
MXISystems website (visited Jan. 11, 2005) <http://www.mxisystems.com>.
Rempe et al. *Optics Lett*., 17(5):363-365 (1992).
Staples et al. *Proceedings of EPAC* 2004, Lucerne, Switzerland, pp. 473-475 (2004).
Tsunemi et al. *IEEE*, Proceedings of the 1999 Particle Accelerator Conference, New York, pp. 2552-2554 (1999).
Yanovsky et al. *Optics Lett*., 19(23):1952-1954 (1994).
Adachi et al., "Subnanosecond-resolved X-ray diffraction at the Spring-8 high flux beamline BL40XU", *Eighth International Conference on Synchrotron Radiation Instrumentation*, Aug. 25-29, 2003, San Francisco, CA; 708:1383-1386 (2004).
Heritage et al., "X-band photoinjector/high gradient accelerator based light source", *Infrared and Millimeter Waves, 2004 and 12th International Conference on Terahertz Electronics, 2004; Conference Digest of the 2004 Joint 29th International Conference on* Karlsruhe, Germany, Sep. 270Oct. 1, 2004, Piscataway, NJ, USA, *IEEE*, pp. 563-564 (2004).
Pagot et al., "Quantitative comparison between two phase contrast techniques: diffraction enhanced imaging and phase propagation imaging", *Phys. Med. Biol*., 50(4):709-724 (2005).
International Search Report and the Written Opinion of the International Searching Authority, or the Declaration for PCT/US2006/010983, dated Sep. 15, 2006.

* cited by examiner

COMPACT, HIGH-FLUX, SHORT-PULSE X-RAY SOURCE

RELATED APPLICATION

This application is a continuation-in-part of prior U.S. application Ser. No. 11/277,393, filed Mar. 24, 2006; this application also claims the benefit of U.S. Provisional Application No. 60/665,434, filed Mar. 25, 2005, the entire teachings of both of these applications are incorporated herein by reference.

BACKGROUND

Hard x-ray sources have been available for nearly 110 years, with a well-established and extraordinary impact on science and technology. From the dozen or more Nobel Prizes recognizing their role in fundamental discovery in chemistry and physics to the medical x-ray, which virtually every citizen of modern developed countries has experienced, x-rays have yielded unparalleled benefits to modern society.

In the last thirty years, the production of extremely high brilliance x-ray beams by accelerator-based sources (i.e., synchrotron radiation) has revolutionized the field of x-ray science and technology. The impact of these sources is comparable with that of the original discovery of x-rays. Using these high-brilliance x-ray beams, scientists are able to (a) see single atomic layers, (b) use weak-magnetic scattering routinely, (c) study dynamic phenomena using inelastic and time-dependent techniques with extraordinary resolution, and (d) spectroscopically probe complex molecules with extremely high resolution. Perhaps the largest impact is coming from "structural genomics"—the application of novel synchrotron-radiation-based diffraction methods to solve the full, three-dimensional, atomic-level structure of all known proteins. In the field of imaging science, synchrotron sources have allowed the much-more-subtle angle and energy shifts, which occur as an x-ray penetrates a material, to be the basis for differentiating different material constituents in an image. This method is known as phase-contrast imaging. Remarkable improvements in image resolution and lowering of dose are now well known. Nevertheless, the scientific impact of these sources is now limited by their gigantic size, which leads to their high cost (i.e., over a billion dollars in some cases) and relative scarcity. Virtually everyone who does research at the synchrotron user facilities does so under extremely limiting conditions of travel and available beam time.

SUMMARY

The x-ray source of this disclosure can produce high-brilliance x-rays at a much lower cost and with a much smaller footprint than existing synchrotron x-ray sources. This compact x-ray source includes a radiofrequency (RF) photoinjector, an accelerator module, and a high-power optical laser apparatus. Both the photoinjector and the accelerator module can be formed of superconducting material. Further, the accelerator module is not a large, ring-type accelerator, but rather can be a compact linear accelerator.

The high-power optical laser apparatus includes a passive enhancement cavity (also referred to as an "accumulation cavity" or as a "coherent cavity"). The cavity adds a sequence of photon pulses of low energy (particularly ultra-short—e.g., picosecond—pulses) to add up to one giant pulse of very high energy.

This compact x-ray source moves the power of a synchrotron source into individual laboratories, thereby enabling a wide range of technologies and fundamental research central to research communities, such as protein crystallography and nano-structure studies. The compact x-ray source also provides exceptional time resolution for a hard x-ray source, opening opportunities for the study of chemical dynamics beyond any existing technology. Further still, this compact x-ray source, because of its small source size and tunable energy, enables improved x-ray imaging (e.g., via phase-contrast imaging) at a lower radiation dose for medical imaging than is achievable with existing x-ray sources in hospitals.

BRIEF DESCRIPTION OF THE DRAWINGS

In the accompanying drawings, described below, like reference characters refer to the same or similar parts throughout the different views. The drawings are not necessarily to scale, emphasis instead being placed upon illustrating particular principles of the methods and apparatus characterized in the Detailed Description.

DETAILED DESCRIPTION

I. Overview of the X-Ray Source

Figure 1:
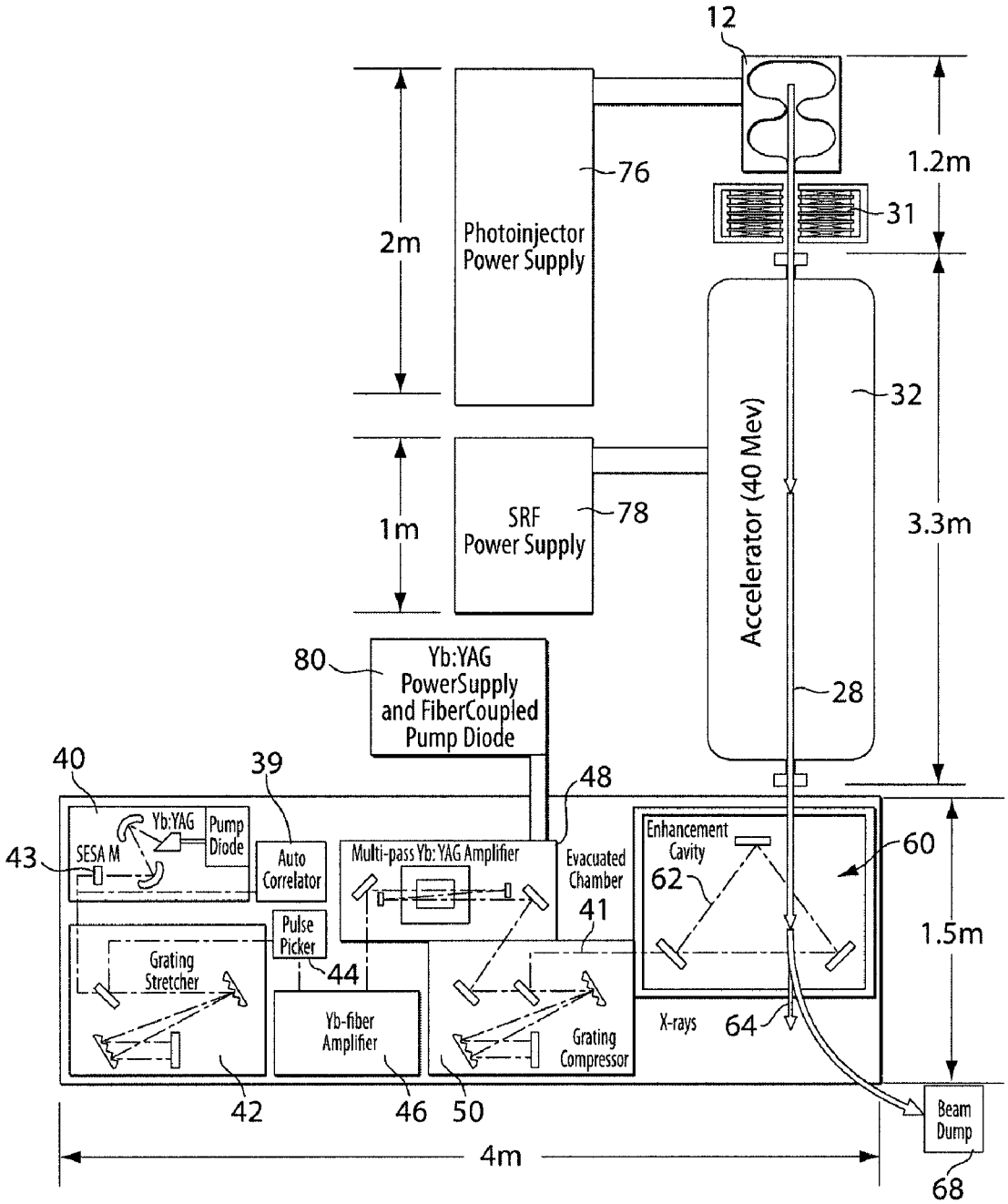
FIG. 1 is an illustration of an x-ray source, wherein a laser table, accelerator components and power supplies are illustrated.
Figure 2:
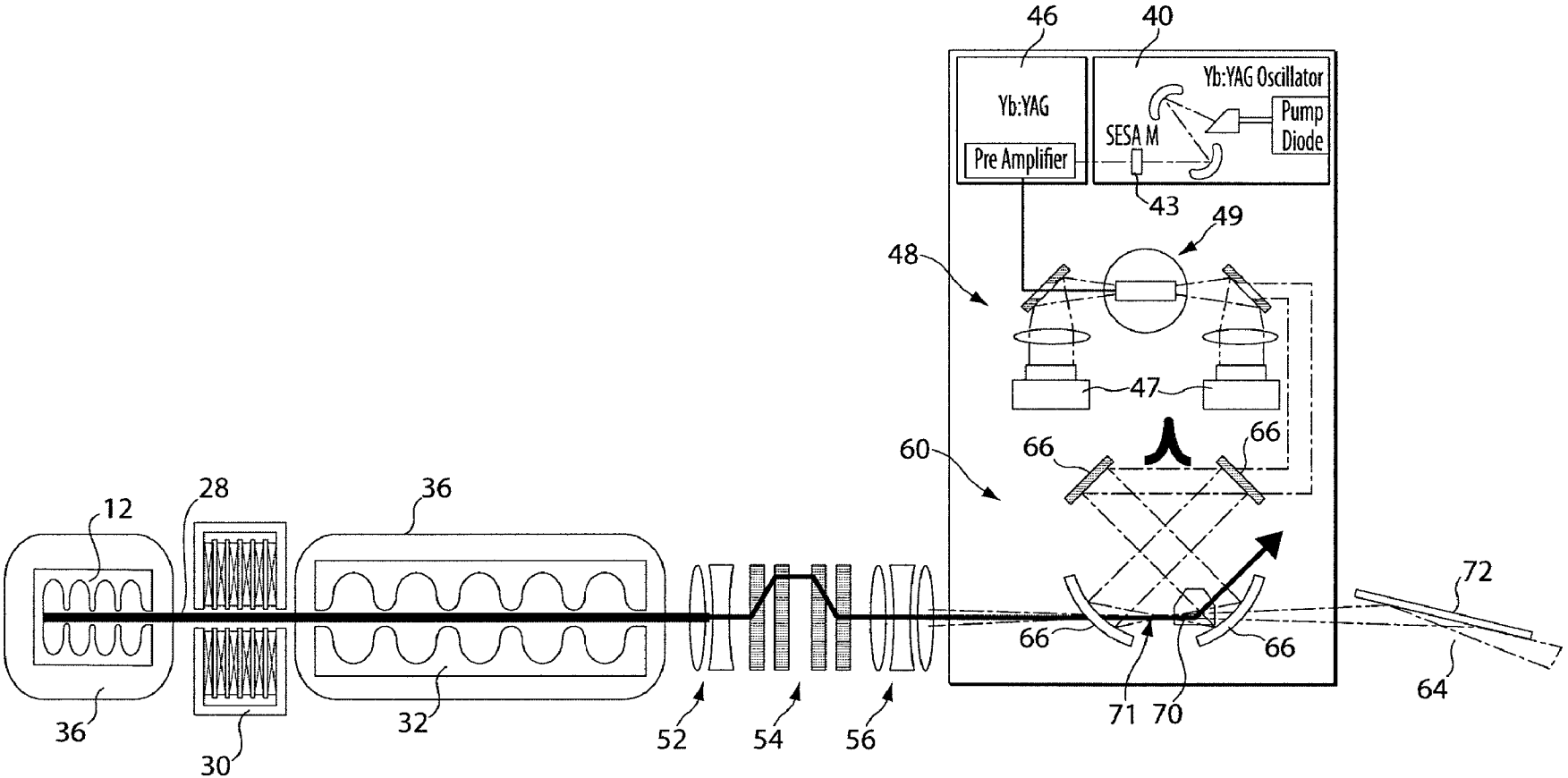
FIG. 2 is an illustration of another embodiment of the x-ray source.

Embodiments of the x-ray source are illustrated in FIGS. 1 and 2. In each embodiment, a laser 40 generates a stream of photons, which are directed into a passive enhancement cavity 60, in which the photons are coherently added in a closed optical path 60 in which the photons then circulate. Meanwhile, a radio-frequency (RF) photocathode gun 12 emits a train of electrons. The electrons are accelerated by a linear accelerator 32 and injected into the passive enhancement cavity 60, where the electrons interact with the photons to generate x-rays 64 via inverse-Compton scattering.

II. Components of the X-Ray Source

Each of the three main components of the inverse-Compton-scattering system is described, below.

A. RF Photoinjector

Figure 3:
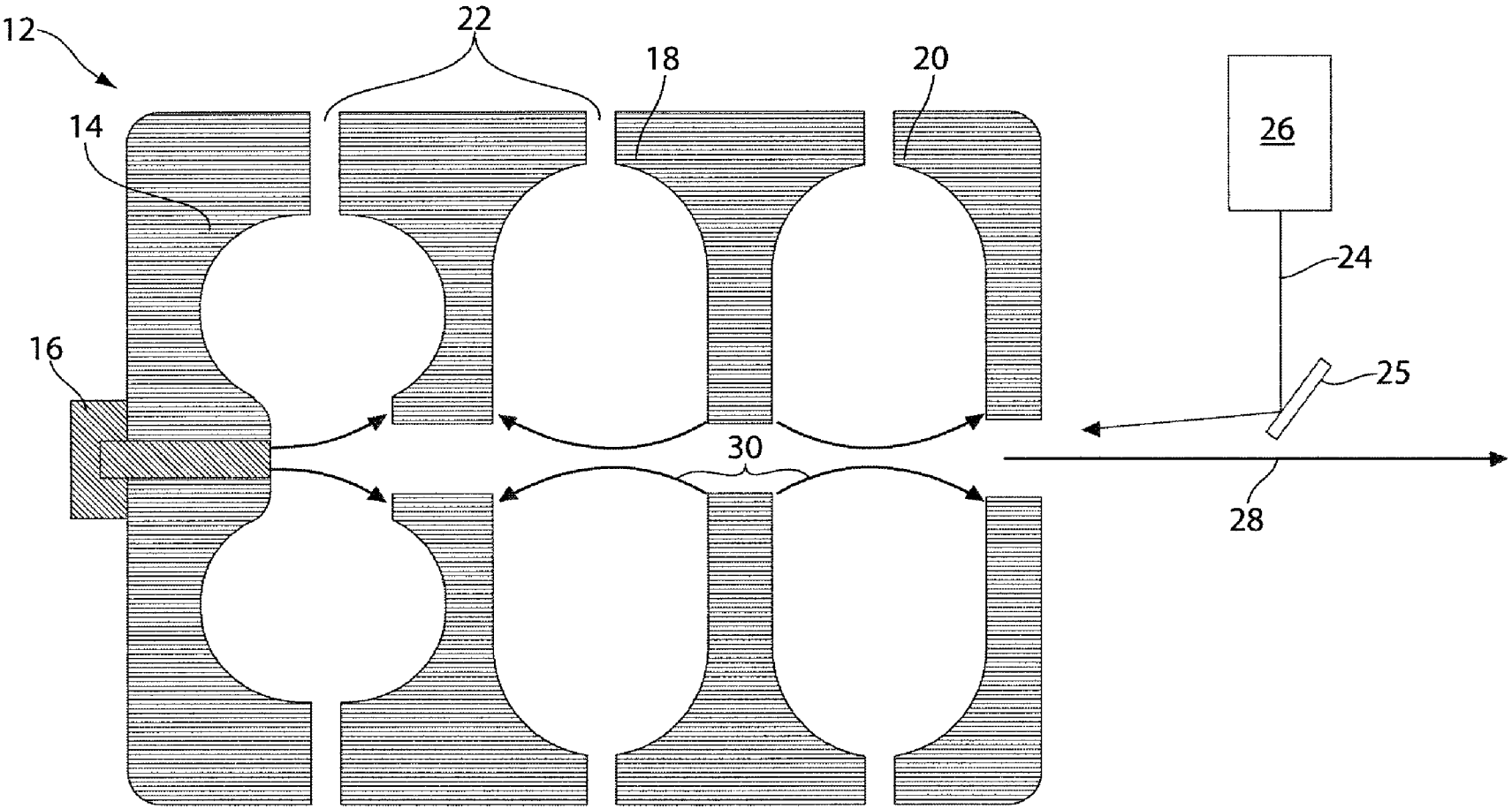
FIG. 3 is an illustration of a high-repetition-rate copper radiofrequency (RF) photoinjector.
Figure 4:
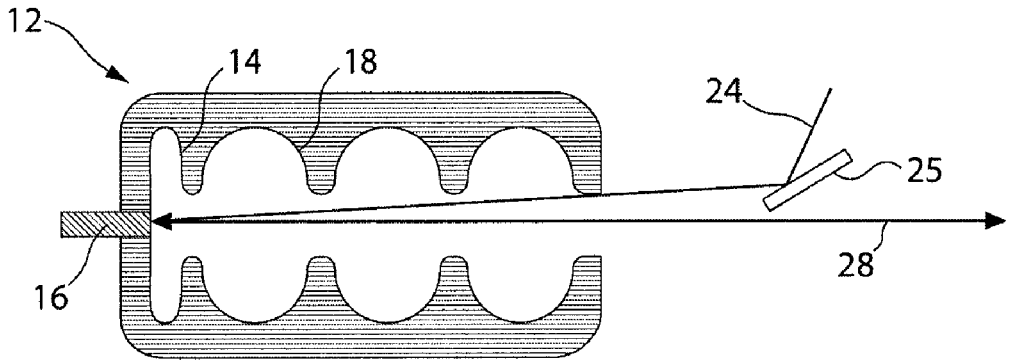
FIG. 4 is an illustration of a high-repetition-rate superconducting radiofrequency (RF) photoinjector.

Electrons are provided in the compact x-ray source from a radiofrequency (RF) photocathode gun 12 (also referred to as an RF photoinjector), shown in FIG. 3. The RF photocathode gun 12 provides up to 1 milli-ampere of electron current at 5 to 10 MeV, with a normalized emittance of less than 1 mm-mrad. The gun includes a 1.3-GHz RF cavity 14 designed to accommodate a removable $Cs_2Te$ photocathode 16, followed by one or more additional accelerating cavities 18 and 20. Additional discussion of the cathode material is provided in R. A. Loch, "Cesium-Telluride and Magnesium for High Quality Photocathodes", Master Thesis, University of Twente, (2005), which is incorporated herein by reference in its entirety. The photoinjector cavities 14, 18, etc. illustrated in FIG. 3 are constructed from copper operating near room temperature for low-repetition-rate applications, and the cavities 14, 18, etc. illustrated in FIG. 4 are constructed from superconducting niobium operating near 2 Kelvin for both low- and high-repetition-rate operation. Additional discussion of suitable photocathode guns is provided in M. Farkhondeh, W. S. Graves, R. Milner, C. Tschalaer, F. Wang, A. Zolfaghari, T. Zwart, J. J. van der Laan, "Design Study for the RF Photoinjector for the MIT Bates X-ray Laser Project," *Proceedings of the* 2003 *Particle Accelerator Conference*, Portland, Oreg. (2003), pp. 956-958 (available at http://accelconf.web.cern.ch/accelconf/p03/PAPERS/MPPB065.PDF), and in J. W. Staples, S. P. Virostek, S. M. Lidia, "Engineering Design of the LUX Photoinjector," *Proceedings of the* 2004 *European Particle Accelerator Conference*, Lucerne, Switzerland, pp. 473-475 (2004) (available at http://accelconf.web.cern.ch/accelconf/e04/PAPERS/MOPKF069.PDF), and in D. Jansen et al, "First Operation of a Superconducting RF-Gun", *Nuclear Instruments and Methods A* 507, pp. 314-317 (2003). The teachings of these documents are incorporated herein by reference in their entirety.

The RF cavities 14, 18 and 20 are powered via power lines that are fed from a power source into power feeds fed through slots 22 in the RF cavities for the room-temperature cavities of FIG. 3 or along the cavity axis for the superconducting cavities of FIG. 4. The room-temperature cavities are operated in the pulsed mode, and the superconducting cavities can be either pulsed or continuous-wave. A photon beam 24 from a laser source 26 is directed via a mirror 25 into the photoinjector 12 (from the right, as shown) to impact the photocathode 16 at the opposite end of the photoinjector 12. The photon beam 24 is optimally shaped to produce uniform, linear space charge forces so that the resulting electron pulse train 28 has the lowest possible emittance following the prescription provided in O. J. Luiten, S. B. van der Geer, M. J. de Loos, F. B. Kiewiet, and M. J. van der Wiel, *Physical Review Letters* 93, pp. 094802-1-094802-4 (2004), the teachings of which are incorporated herein by reference in their entirety. For operation up to 300 pico-Coulombs of charge per bunch, this shaping is in the form of a parabolic radial intensity profile and a temporal width of less than 500 femtoseconds full width at half maximum. For operation at higher charges, the laser pulse shape is a three dimensional ellipsoid of uniform intensity.

The impact of the photons 24 on the cathode 16 causes the cathode 16 to eject electrons 28, which are likewise temporally bunched into pulses. The temporal bunching of the electrons enhances the responsiveness of the electron stream 28 to RF (sinusoidal) acceleration as the bunched electrons 28 are channeled through the photoinjector 12 across electromagnetic fields generated by the RF cavities 14, 18, and 20 (to the right, as shown), wherein the electromagnetic field lines 30 are illustrated in FIG. 3. The RF cavities 14, 18 and 20 are carefully designed to provide a high accelerating gradient (e.g., greater than 40 $MVm^{-1}$ at the cathode surface) at RF pulse repetition rates of up to 10 MHz. In one embodiment, the RF cavities 14, 18 and 20 are operated at about 3 kHz. As the charge per pulse of electrons 28 is increased (above a minimum floor for x-ray generation), more x-rays are generated.

After the electron stream 28 exits the photocathode gun 12, it passes through a solenoid focusing magnet 31 before it reaches an accelerator cryomodule, which includes a linear accelerator 32 and a cryostat 36.

B. Superconducting Accelerator Module

Figure 5:
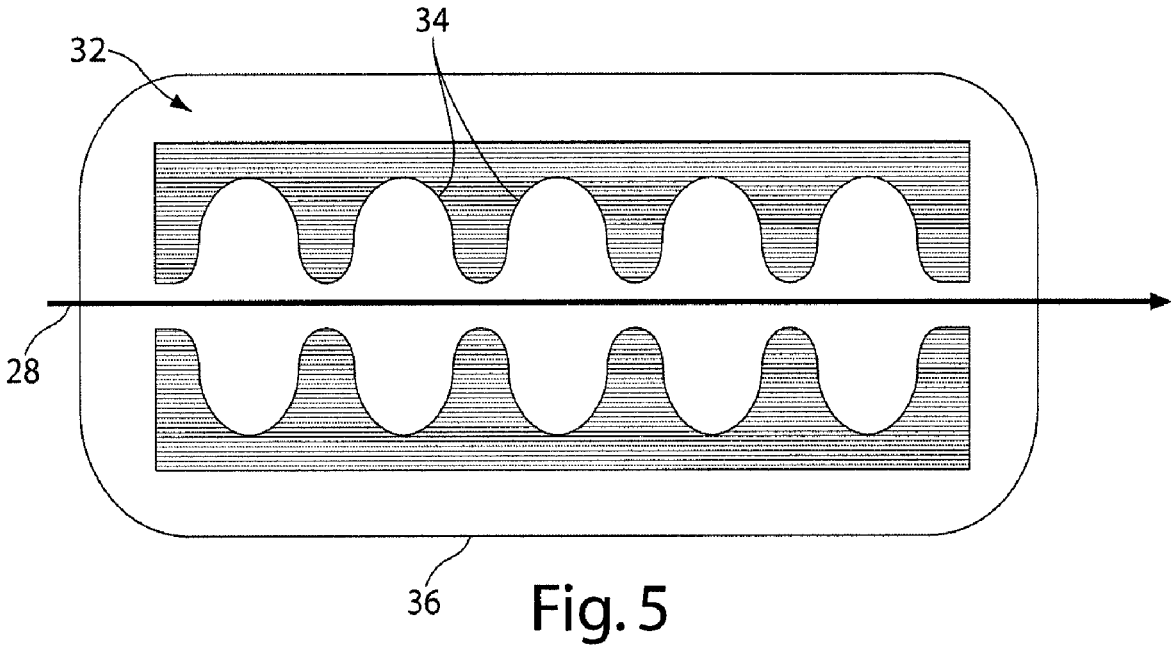
FIG. 5 illustrates a multi-cell superconducting RF accelerating cavity.

A fixed-frequency superconducting linear accelerator 32 including RF accelerating cavities 34 formed of niobium is illustrated in FIG. 5. To keep the niobium cooled to below its critical superconducting temperature, the accelerator module 32 is contained within a cryostat 36. This module 32 is the primary mechanism for tuning the electron stream 28 that is generated by the photoinjector 12 and is used to reach a final electron stream energy of 40 MeV.

Superconducting RF cavities 34 in the cryomodule are much more efficient than copper accelerator structures for high-repetition-rate, high-energy operation. A suitable cryomodule is now available commercially from Accel Instrument GmbH (of Bergisch Gladbach, Germany). Power for the RF cavities 34 is supplied by inductive output tubes (IOTs), which are attractive as compact and efficient ($\eta \cong 50\%$) RF sources and have only recently been developed for operation at this RF frequency.

The accelerator cryomodule is a compact device, measuring 3.3 m in overall length. It will be operated at a temperature of 2 K. With a final energy of 40 MeV, x-rays of up to 30 keV can be produced. If harder photons are required, an additional cryomodule can be added, boosting the electron stream energy to 70 MeV and the resulting x-ray photon energy to over 90 keV. The accelerator 32 can be operated in continuous-wave mode for maximum stability, or in pulsed mode to reduce the duty-cycle thus conserving power and reducing liquid helium consumption.

To tune the x-ray pulse length, the electron stream 28 can be compressed or stretched by running the RF section off-crest, which causes a correlation of beam energy with time (e.g., a chirp) across the pulse. The electron stream 28 is then run through a dispersion section that stretches or compresses the stream depending on the slope of the chirp. As shown in FIG. 2, the dispersion section can include quadrupole focusing magnets 52 and 56 and dipole magnets 54 arranged into a chicane configuration for beam collimation and bunch compression.

In other embodiments, the electron stream can be supplied by pure laser acceleration [see S. Mangles, et al., "Monoenergetic Beams of Relativistic Electrons from Intense Laser-Plasma Interactions," 43 Nature 535-38 (2004); C. Geddes, et al., "High-Quality Electron Beams from a Laser Wakefield Accelerator Using Plasma-Channel Guiding," 43 Nature 538-41 (2004); J. Faure, "A Laser-Plasma Accelerator Producing Monoenergetic Electron Beams," 43 Nature 541-44 (2004); T. Katsouleas, "Electrons Hang Ten on Laser Wake," 43 Nature 515-16 (2004); each of these references is incorporated herein by reference in its entirety]. Alternatively, the electron stream can be supplied by a combination of photo cathodes and laser acceleration.

Figure 6:
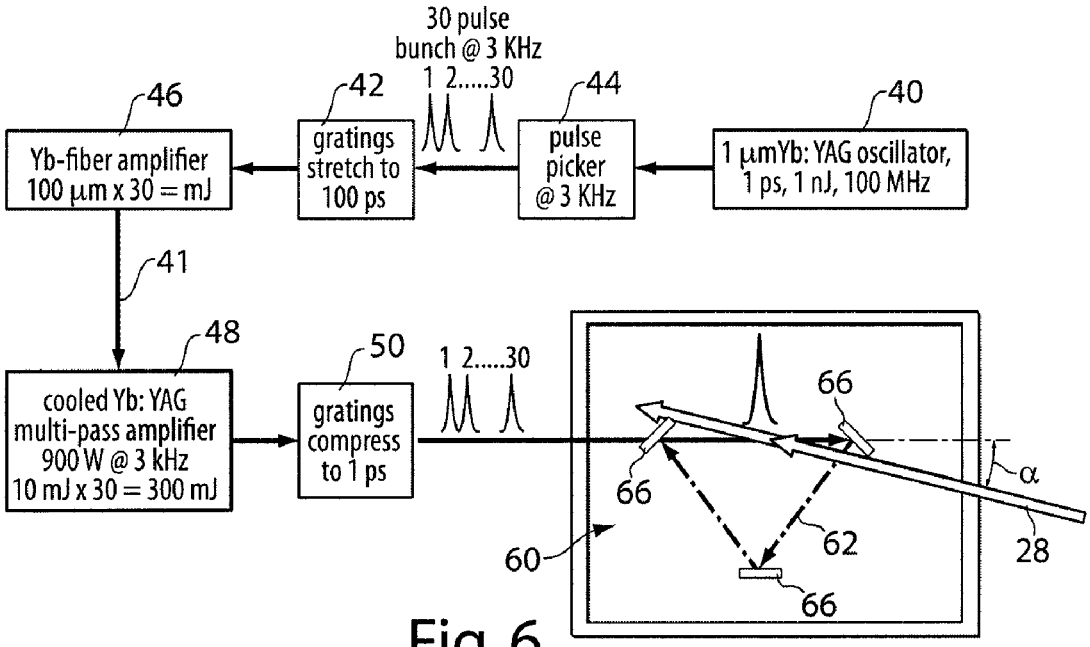
FIG. 6 is a schematic illustration of picosecond chirped pulse amplification and pulse addition in an enhancement cavity using an apparatus of this disclosure.
Figure 7:
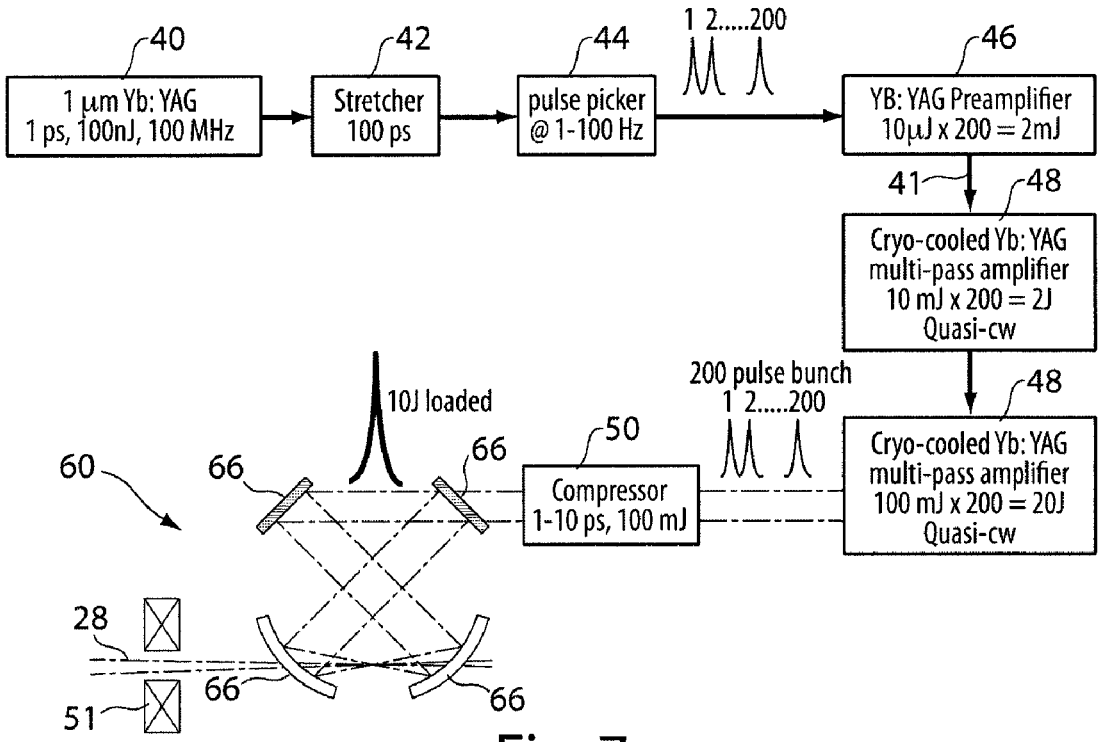
FIG. 7 is a schematic illustration of another embodiment of picosecond chirped pulse amplification in an enhancement cavity using an apparatus of this disclosure.

C. High-Power Optical Laser:

Schematics of picosecond chirped-pulse amplification and pulse addition in enhancement cavities 60 at 900 W average power are provided in FIGS. 6 and 7.

It is advantageous to use the most efficient diode-pumped laser 40 in this apparatus (e.g., Yb-based solid-state, such as Yb-YAG, or fiber lasers, which are cost effective and have been scaled to kW average power because of their use in manufacturing, such as in machining and welding). Such lasers are commercially available in the form of thin disc lasers from the company, Trumph-Haas of Germany, or in the form of fiber lasers from IPG-Photonics of Oxford, Mass., USA; and even-more advanced systems are under development, such as those demonstrated by Daniel J. Ripin, Juan R. Ochoa, R. L. Aggarwal, and Tso Yee Fan, "165-W Cryogenically Cooled Yb:YAG Laser," Optics Letters 29, 2154-2156

(2004). Yb-based lasers also have a bandwidth large enough to amplify pulses that are 0.5-5 ps in duration. There are also lasers using other materials for 5-15 ps pulses, which are less efficient by about a factor of 1.5 to 2. Examples of such materials include Nd:YLF and Nd:YAG.

A diode-pumped, mode-locked laser 40 with subsequent amplification can develop 1 kW of average optical power from about 3 kW electrical wall-plug power. This optical power can be delivered in various pulse formats, such as a continuous stream of picosecond pulses at high (10-100 MHz) repetition rate or as a burst stream (30-100 pulses, 10 mJ in energy and pulse-to-pulse separation of 10 ns) at a repetition rate of 3 kHz and with an extended time gap between each burst stream (see FIG. 6) or in a burst stream of even-lower repetition rate (10 Hz) of higher-energy pulses (100 pulses each 300 mJ). Accordingly, the format of the laser-generated pulse stream 41 (also referred to as an optical pulse stream) can be the same as or similar to that of the electron stream 28.

The laser 40 in FIG. 6 utilizes an ytterbium-doped yttrium aluminum garnet (Yb:YAG) laser crystal to generate a photon beam 41 having a wavelength of about 1 micron at a 1 picosecond pulse length and a 1 nanoJoule energy for each pulse; the repetition rate of pulses is 100 MHz. The laser 40 in FIG. 7 generates a pulse stream with 100 nJ per pulse with parameters otherwise similar to the laser in FIG. 6. After leaving the laser 40, the stream of pulses 41 passes through a pulse picker 42 that is electronically driven and synchronized to the laser pulses and through a grating stretcher 42 (stretching the pulse length to 100 picoseconds). The energy of the photon stream is then amplified in a fiber preamplifier 46 to avoid nonlinearities in the subsequent amplifiers. In the fiber amplifier 46 of FIG. 6, the 30 pulses are amplified from each having 1 nJ to 100 μJ each, or to a total average power of 10 W. This amplification happens in two stages, the first one amplifying by a factor of 1,000 to an average power of 100 mW and then in the second stage by another factor of 100 to the 10 W level.

Next, the photon pulse train is directed through one or more multi-pass power amplifiers 48 and amplified by another two orders of magnitude to the 1 kW average power level. As shown in FIG. 2, the amplifier 48 can include a pair of diode-pumped lasers 47 with a liquid-nitogen-cooled Yb:YAG crystal 49 positioned therebetween. The photon pulse train is then passed through a grating compressor 50 to compress the pulses again to 1 ps, which increases the peak power by a factor of 100. The grating stretcher and compressors can also be replaced by other technologies, such as Gire-Tournois interferometers.

Additional features of the laser and optics system can be seen in FIG. 1, such as an auto-correlator 39, which measures pulse width, and a semiconductor saturable absorber mirror (SESAM) 43 that is used for modelocking of the Yb-YAG oscillator 40 (i.e., it is responsible for the short pulse generation). Each of the other illustrated components that redirect the photon stream, other than the gratings, is a mirror.

Meanwhile, the electron stream 28 can be focused with magnets 51, shown in FIG. 7, before entering the enhancement cavity 60 and can either be directed around the mirrors 66, as shown in FIG. 6, or be directed through small orifices (e.g., laser-drilled holes) in the mirrors 66, as shown in FIGS. 2 and 7 (i.e., the two mirrors at the bottom of the enhancement cavity in FIGS. 2 and 7 having holes drilled there-through for the electron stream 28 or for the emitted x-ray beam 64).

The laser-generated optical pulse stream 41 is then loaded into a high-Q enhancement cavity 60. At a high repetition rate (e.g., 10 MHz), this loading occurs continuously. At a low repetition rate (e.g., <100 kHz), the loading of a burst of pulses starts from an empty cavity 60. The coherent loading leads finally to the formation of a single 10 mJ pulse in the case of a high repetition rate or up to 10 J in the case of a low (e.g., 10 Hz) repetition rate. The roundtrip time of the pulse in the cavity 60 is equal to a multiple of the RF period of the accelerator 32. This accumulated optical pulse in the enhancement cavity 60 collides in each roundtrip with a new electron bunch 28, emitting an x-ray pulse 64. The higher the Q value of the cavity 60, the more collisions can occur. For the x-ray characteristics in Table 1, we assumed a Q value of 100, so that at least 30 collisions can be successfully executed without excessive loss in the optical pulse. If the Q value is particularly high, dispersion compensation can be employed to avoid excessive broadening of the pulse (e.g., by using chirped mirrors).

The enhancement cavity 60 can be maintained under vacuum and is passive, meaning that the components of the cavity 60 do not contribute energy to the optical field stored in the cavity 60 and that the cavity 60 is empty until fed by an outside source. An "active" enhancement cavity, in contrast, may include a laser medium inside of it, providing gain to the optical field, which may also compensate for losses therein.

Two or more mirrors 66 can be used in the enhancement cavity 60 to define a closed optical path 62 in which the laser-generated photons are circulated. Using modern mirror technology, which includes very-low-loss mirrors, from 30 optical pulses up to a million pulses can be added if a very-high-quality cavity is used. Very-low-loss mirrors are described, e.g., in G. Rempe et al., "Measurement of Ultralow Losses in an Optical Interferometer," 17 Optics Letters 5, pp. 363-365 (1992), which is incorporated by reference herein in its entirety. Such low-loss mirrors are provided by Newport Inc (Irvine, Calif., USA) or Advanced Thin Films (Longmont, Colo., USA).

Accumulation of so many optical pulses in the cavity 60 is promoted by advances in frequency metrology, which enable the cavity 60 to be locked very precisely to the comb of a mode-locked laser 40 that seeds the amplifier that generates the pulse stream for the cavity loading. See, e.g., V. Yanovsky, et al., "Frequency Doubling of 100-fs Pulses with 50% Efficiency by Use of a Resonant Enhancement Cavity," 19 Optics Letters 23, pp. 1952-1954 (1994), and R. Jones, et al., "Femtosecond Pulse Amplification by Coherent Addition in a Passive Optical Cavity," 27 Optics Letters 20, pp. 1848-1850 (2002); these two articles are incorporated herein by reference in their entireties.

By using a passive cavity 60 that is empty other than the injected photon and electron streams 41 and 28, a very-high quality factor is obtained, enabling the loading of up to a million pulses. Accordingly, one can generate a stream 41 of low-energy optical pulses with large average power; and the cavity 60 adds it to a single high-energy optical pulse. Another advantage of the enhancement cavity is that the need for chirped-pulse amplification is strongly reduced. To avoid deterioration of the beam quality by nonlinearities in the amplifier, typical amplifiers need to stretch the picosecond pulse to nanosecond duration in a stretcher. After amplification, the pulses are compressed. For the high-repetition-rate system, stretching and compression is not necessary because the individual pulses have relatively low energy and the high-energy pulse is only generated in the enhancement cavity; accordingly, stretchers and compressors can be omitted. With a low repetition rate, moderate stretching and compression up to about 100 ps may be employed. Gire-Tournois Interferometers can achieve the stretching and compression for picosecond pulses, which is described in F. Gires and P. Tournois, "Interferometre Utilisable Pour la Compression D'impulsions Lumineuses Modulees en Frequence," *C. R. Acad. Sci. Paris*, vol. 258, pp. 6112-6115, 1964, which is incorporated herein by reference in its entirety.

In principle, the enhancement cavity 60 can also be used to additively accumulate femtosecond pulses. Femtosecond x-ray pulses can be achieved even with a picosecond laser, if the pulse bunch is only femtoseconds short (for example, 100 fs). However, the coherent addition of femtosecond pulses is made more difficult due to dispersion in the cavity 60.

An advantage of using a super-high-Q cavity (e.g., Q=100,000) lies in the fact that one can load the cavity 60 with a constant optical pulse stream 41 from an amplified mode-locked laser 40 at regular repetition rates (for example, at 100 MHz), where each pulse carries, for example, 1-10 micro-Joules of energy (i.e., 100 W to 1 kW average power). Such small pulse energies can be easily obtained from bulk solid-state lasers or from fiber lasers with external amplification without running into nonlinear problems. When a fiber laser is used, the photon stream can be stretched and compressed; however, the stretching and compression can be carried out in a robust way (i.e., also in special fiber).

When that optical pulse stream 41 falls onto the enhancement cavity 60, an intracavity pulse energy of 100 mJ to 1 J circulates within the cavity 60. When an electron bunch 28 passes through the enhancement cavity 60, it will extract energy from the optical beam 62 and may also damage the beam 62 by defocusing, though the beam 62 circulating in the cavity is replenished afterwards by the next sequence of the pulse stream 41. Modern techniques in frequency metrology and laser stabilization make it possible today to keep such a high-quality cavity 60 in resonance with the incoming stream 41, such as femtosecond laser frequency combs, as described in "Femtosecond Optical Frequency Combs," by S. Cundiff and J. Ye, Rev. Mod. Phys. 75, 325 (2003), which is incorporated herein by reference in its entirety As an alternative to using a mode-locked laser, a continuous-wave (CW) laser or a Q-switched laser can be used. Either of these laser types can be used to gradually fill the enhancement cavity 60 to likewise produce x-rays 64 via inverse-Compton scattering when the electrons 28 are injected into the enhancement cavity 60.

Additional discussion of coherent addition of optical pulse trains using an enhancement cavity is provided in the following references: B. Couilland, et al., "High Power CW Sum-Frequency Generation Near 243 nm using Two Intersecting Enhancement Cavities," Opt. Commun. 50, 127-129 (1984); R. J. Jones, et al., "Femtosecond Pulse Amplification by Coherent Addition in a Passive Optical Cavity," Opt. Lett. 27, 1848-1850 (2002); E. O. Potma, et al., "Picosecond-Pulse Amplification with an External Passive Optical Cavity," Opt. Lett. 28, 1835-1837 (2003); Y. Vidne, et al., "Pulse Picking by Phase-Coherent Additive Pulse Generation in an External Cavity," Opt. Lett. 28, 2396-2398 (2003); and T. Hänsch, et al., "Method and Device for Generating Phase-Coherent Light Pulses," U.S. Pat. No. 6,038,055. The teachings of each of these documents are incorporated by reference herein in their entirety.

Additionally, as shown in FIG. 2, a dipole magnet 70 can be positioned in the cavity 60 just past the region 71 at which the electrons interact with the photons to produce the s-rays in the cavity 60. The dipole magnet 70 serves to deflect the electron beam to an electron beam dump outside the cavity 60.

III. Use of the X-Ray Source

Compton-scattering x-ray sources have already shown promising results at low repetition rates. In particular embodiments, we propose to enhance the peak flux by a factor of 10 and the average x-ray flux by a factor of $10^4$ over existing compact x-ray sources (W. J. Brown, et al., Physical Review ST-AB v22, n3, 2004 and R. W. Schoenlein, et al., Science 274, 236-238, 1996) via the use of high-brightness superconducting electron guns and superconducting accelerator sections, and also via ultra-short laser pulse generation at high power levels (achieved via the use of a coherent cavity) and with high efficiency. Together, these components can produce a flux of x-rays that rivals the output from a third-generation synchrotron bending magnet beamline and exceeds that of the best of existing laboratory-based systems by several orders of magnitude. This x-ray source has wide application in academic and industrial research laboratories because of its relatively small size and cost. This x-ray source can also have a great impact on medical imaging because its monochromatic, coherent beam is advantageous for phase-contrast imaging (wherein the perturbation of x-rays, rather than the absorption of x-rays, by components in a scanned material is measured and evaluated) with low dose to the patient.

The design parameters for one embodiment of the laser source in the x-ray source are provided in Table 1, below.

TABLE 1

| | |
|---|---|
| Photon energy: | tunable, monochromatic from 4-30 keV |
| Photon pulse length: | 0.1-30 ps |
| Flux per shot: | $1.4 \times 10^8$ photons |
| Photon pulse format: | 30 pulses at 3 kHz |
| Peak flux: | $1.4 \times 10^{20}$ photons/sec @ 1 ps pulse length |
| Average flux: | $1.2 \times 10^{13}$ photons/sec |
| Source mean divergence: | 10 mrad |
| Source full-width half-maximum (FWHM) size: | 0.025 mm |
| Bandwidth: | <10% |
| Peak brilliance: | $1.3 \times 10^{21}$ photons/(sec mm$^2$ mrad$^2$) |
| Average brilliance: | $1.1 \times 10^{14}$ photons/(sec mm$^2$ mrad$^2$) |

This x-ray source is designed to have a time average flux about four orders of magnitude larger than today's rotating anode tubes. This flux is comparable with that from bending magnet synchrotron sources, although with larger bandwidth. The x-ray source is tunable and has a short-pulse structure, giving high-peak brilliance. While the largest societal impact of such an x-ray source may be to replace the current generation of medical x-ray sources with a vastly improved x-ray source capable of supporting phase-contrast imaging, as described below, many other applications for the x-ray source also exist.

Important aspects of the design include the ability to (1) vary the repetition rate of the linear accelerator (linac), (2) adjust the charge and emittance properties of the electron beam produced by the superconducting injector, (3) adjust the energy of the superconducting linac, and (4) adjust the properties of the laser system including pulse rate, power, and polarization to optimize the output photon beam's properties for the particular application.

In two other embodiments, the concept is optimized for high single-pulse power, and for high time-average flux. The performance of the concept is described for each of these respectively in Tables 2 and 3 for radiation produced at 12 keV.

TABLE 2

| (parameters for x-ray source operating at 10 Hz): | |
|---|---|
| Photon energy [keV]: | 4-30 |
| Total x-ray flux per pulse (17% bandwidth): | $4 \times 10^9$ |

TABLE 2-continued

| (parameters for x-ray source operating at 10 Hz): | |
|---|---|
| Peak spectral density per pulse [photons/eV]: | $2 \times 10^6$ |
| Repetition rate [Hz]: | 10 |
| Average x-ray flux @ 10 Hz [photons/sec] (17% bandwidth): | $4 \times 10^{10}$ |
| On-axis spectral width FWHM [keV]: | 0.2 |
| Spectral width FWHM [keV]: | 2 (17%) |
| Average brilliance [photons/(mm$^2$ mrad$^2$ sec 0.1%)]: | $1.4 \times 10^{10}$ |
| Peak brilliance [photons/(mm$^2$ mrad$^2$ sec 0.1%)]: | $1.4 \times 10^{20}$ |
| Pulse length FWHM [ps]: | 9 |
| Size of source, root mean square (RMS) [μm]: | 7 |
| Opening angle RMS [mrad]: | 7 |

TABLE 3

| (parameters for x-ray source operating at 10 MHz): | |
|---|---|
| Photon energy [keV]: | 4-30 |
| Total x-ray flux per pulse (5% bandwidth): | $5 \times 10^5$ |
| Peak spectral density per pulse [photons/eV]: | 800 |
| Repetition rate [MHz]: | 10 |
| Average x-ray flux @ 10 MHz (0.1% bandwidth): | $2 \times 10^{11}$ |
| On-axis spectral width FWHM [keV]: | 0.1 |
| Spectral width FWHM [keV]: | 0.6 (5%) |
| Avg on-axis brilliance [photons/(mm$^2$ mrad$^2$ sec 0.1%)]: | $6 \times 10^{14}$ |
| Peak on-axis brilliance [photons/(mm$^2$ mrad$^2$ sec 0.1%)]: | $2 \times 10^{19}$ |
| Pulse length FWHM [ps]: | 0.1-3 |
| RMS size of source [mm]: | 4 |
| RMS opening angle [mrad]: | 3.5 |

In the above tables, all parameters expressed in percentages refer to bandwidth. In Table 3, the bandwidth of the photons is 5% at the laser source, though it is monochromatized to 0.1% bandwidth.

One large commercial use for the x-ray source is in the high-flux mode of Table 3 for medical imaging and for protein crystallography. As an application example, we describe the potential for the monochromatic x-rays to dramatically improve medical imaging. In current practice today, the traditional x-ray tube produces a bremsstrahlung spectrum over a range from 5 to 75 keV. At typical tube power, the beam may have about $10^9$ photons/sec/mm$^2$/mrad$^2$. This power level is low compared to the level expected from the ICS of over $10^{14}$; and furthermore, all of the photons in the tube spectrum are not as useful as the ICS photons produced over a narrow bandwidth. Below 10 keV, photons from the tube source are readily absorbed by the skin of a patient and are not useful for imaging. The high-energy photons above the 60 to 70 keV do not have large absorption contrast in soft tissue; and, furthermore, they scatter more strongly, leading to increased background. The ICS source will surmount these problems and lead to images of much higher quality.

In addition to the improvements to image quality that result from the narrower bandwidth and higher flux beams, the ability to tune the photon energy will open up new types of diagnostic modalities compared with standard radiography. One can tune to the absorption edge of a particular atom, such as iodine (used as an agent to improve blood contrast) or gadolinium (which can be incorporated in molecules that will bind to specific sites relative to specific biological function). The development of contrast agents and novel imaging methods is essential to enhancing medical care.

While these advances are significant in their own right, another major impact is expected. The inverse-Compton-scattering (ICS) x-ray source is well suited to phase contrast imaging because of the small spot size, which results in high coherence. In phase-contrast imaging, the x-rays diffract from variations in the object's index of refraction, changing their angle slightly as they pass through the material. These effects are pronounced when the beams are coherent, as they are from an ICS source whose size is less than 10 microns. As a result, there will be significant improvement in image contrast and resolution for soft tissue compared with conventional absorption-based imaging. Computer simulations of this effect show enhancements of many orders of magnitude in the ability to detect small differences in index of refraction compared to standard x-ray absorption methods.

Another example is the application to protein crystallography. With the potential to achieve 10 MHz pulse rates from superconducting linear accelerators, the time-average beam parameters shown in Table 3 are competitive with the best 2$^{nd}$ generation synchrotron sources and with bending magnet-based beamlines at 3$^{rd}$ generation sources. This capability would far exceed what is available in protein crystallography "home" laboratories today, which use rotating anodes with 4 to 5 orders of magnitude poorer performance in beam brilliance. The benchmark for protein crystallography today at 3$^{rd}$ generation undulator sources is a beam with $10^{12}$ photons/sec in a 0.1% bandwidth and a source size defined by an aperture having a diameter of approximately 100 microns. Such a source allows a frame to be taken in one second. Investigators familiar with this routine indicate that a source of $10^{10}$ photons/sec would be extremely attractive, particularly in the home laboratory.

From Table 3, we see that the flux of $2\times10^{11}$ is possible at 0.1% bandwidth. Collimating this radiation with an aperture that transmits radiation only within a full-width of 3 mrad would yield $4\times10^{10}$ photons/sec. The beam could be re-imaged at the sample with a full-width less than 10 microns, thus making this embodiment suitable for protein crystallography with very small crystals with dimensions of order 10 microns. This is not possible today with rotating anode sources.

There are many other uses for the high time-average flux of Table 3. For example, in materials science, this x-ray source brings the ability to study diffraction from single atomic layers, including surface layers and buried layers and interfaces, to the laboratory. Magnetic scattering is possible with this x-ray source, as is inelastic x-ray scattering with resolution down to 100 meV.

Particularly advantageous is the short-pulse feature of the x-ray source, with performance parameters in Tables 1 and 2. With a nominal pulse length of 1 ps, the x-ray source will have a shorter pulse duration than today's synchrotron sources by one to two orders of magnitude. Also straightforward is the further reduction of the pulse length to the 100 fs level, with a corresponding decrease in photon flux. The importance of this characteristic short-pulse duration is twofold. With sub-picosecond time constants, one enters the dynamical range of high scientific interest for the study of dynamics of chemical and condensed-matter systems. One picosecond is equivalent to a few milli-volts in the energy domain, which is the natural time regime of chemical reactions and interesting condensed-matter phenomena, such as high-temperature superconductivity in correlated electron systems. One way to imagine the possibilities for time-dependent studies is to note that the flux from the x-ray source in one 1-ps pulse is about the same as the flux in one second from a rotating anode source.

Therefore, the ICS x-ray source can enable time-dependent spectroscopy-based methods, such as Extended and Near Edge X-ray Absorption Fine Structure (EXAFS and NEXAFS), to be exploited in the small laboratory environment. Interestingly, in this field, the development work made possible by synchrotron sources allowed basic time-independent XAFS spectroscopy methods to be so well understood that they could be exploited on rotating anode sources. With this x-ray source, it will be possible to routinely conduct time-dependent XAFS-type experiments in a small laboratory environment using the modes of operation represented by Table 1 or 2, depending on the method and frequency of exciting the sample.

Another example of the application of the high single-pulse power mode is to the diffraction study of the time-dependent behavior of molecules undergoing reactions relevant to their biological and/or chemical function. The application utilizes the large bandwidth of the Laue method. It is estimated that a single shot flux of $10^9$ to $10^{10}$ would enable data to be collected in a single shot per exposure. As can be seen from Table 1, our concept will achieve that level of flux in a bandwidth appropriate for the Laue method. From Table 1, we see the RMS divergence of the source in the single shot mode is 5 mrad. This is too large by about a factor of 10 and will cause prohibitive spot broadening on the detector. The solution to this problem is to take advantage of the very-small spot size (7 micron RMS) and to use magnifying optics to trade size for divergence. We discuss such optics issues in the following section regarding x-ray optics. Our conclusion then is that signal rates as good or better than those currently available for such studies at synchrotron facilities with 100 pico-second resolution can be achieved with pulse durations as short as 1 ps.

IV. X-Ray Optics

An x-ray optic 72 for focusing, collimation, and monochromatization of the generated x-ray beam 64 is illustrated in FIG. 2.

In order to deliver appropriately tailored x-ray beams for various applications, use can made of focusing and/or collimating devices as well as energy-selection devices. Although the ICS source has spectral features quite different from those of either a traditional x-ray tube or a synchrotron source, many of these functions are similar to those in use for such sources, and optical components are readily available.

As an example, consider the x-ray method of small-angle scattering, which requires a highly collimated beam. The ICS source divergence is too large to facilitate this method without modification. Standard reflective mirrors configured in the Kirkpatrick-Baez geometry are available from a number of sources and can be used in the beam magnification mode to decrease beam divergence while increasing beam size. Specialized multilayer optics available from Osmic Corporation can be used to collect and collimate even larger solid angles from the ICS source than can be achieved with standard metal-coated mirrors.

A much more important and challenging application is protein crystallography, as described earlier. In this case, the x-ray beam 64 is focused, and a narrow bandwidth is provided. To apply this method to 10-micron-size protein crystals, a combination of focusing and monochromating elements is employed. To obtain adequate flux on the sample without undue spot broadening, a bandwidth of up to 0.2% can be utilized for the fixed wavelength measurements, generally used for small molecule or co-crystal studies in the pharmaceutical industry. As a specific embodiment of such an optics method, we propose a collimating multilayer collecting of order 10 mrad×10 mrad from the ICS source, situated approximately 20 cm from the source, and collimating the radiation in one direction to about 50 micro-radians. This is possible with a parabolic multilayer mirror manufactured by the Osmic Corporation having an 85% reflectivity. Next, the collimated radiation is incident on a highly asymmetrical Ge(111) crystal pair, with asymmetry angle of 0.6 to 1.1. degrees (e.g., approximately 0.7 degrees) less than the Bragg angle. Each crystal would be about 20 cm in length. Such crystal system would have a bandpass of 16 eV and a reflectivity of 67% according to our calculations. Suitable asymmetric crystals are described in Yu. Shvyd'ko, *X-ray Optics: High-Energy-Resolution Applications*, Springer Series in Optical Sciences, W. T. Rhodes series editor, Springer-Verlag, Berlin Heidelberg (2004), which is incorporated by reference in its entirety.

Finally, this x-ray beam is focused to a spot three times larger than the source size, approximately 30 microns, again with multilayer optics from the Osmic Corporation focusing in two directions. We estimate that $6\times10^{10}$ photons/sec or greater would be available in the focal spot, making it possible to do routine fixed-wavelength protein crystallography with 10 micron crystal samples.

In order to use the ICS for multiple-wavelength-anomalous-diffraction (MAD) studies for ab initio protein structure determinations from large molecules, an embodiment similar to the above is employed, but with asymmetric Si(111) crystals. An energy bandpass of 7 eV can be achieved with 80% reflectivity at the Selenium K-edge (12.6 keV) with a tunability of 200 eV using crystals cut with an asymmetry angle of about 8 degrees, thereby accepting the 50 microradian output from the upstream collimating mirror. This energy resolution and tuning range should be adequate for such MAD studies, and the photon flux would be approximately $3\times10^{10}$ photons/sec.

V. System Integration

The layouts for different embodiments of a facility showing an operational configuration (with dimensions) of the laser table, photocathode gun 12, accelerator 32, and power supplies 76, 78, and 80 are illustrated in FIGS. 1 and 2.

The spot area 71 where the photons collide with the electrons in the enhancement cavity is about 10 μm×10 μm or less. The number of x-ray photons that are produced can be scaled up, perhaps to $10^{10}$ photons/pulse, by operating the high-power laser system at a lower repetition rate with higher energy per pulse. Such a high single-shot photon number would enable time-resolved x-ray diffraction of molecules with resolution of 100 fs to 1 ps from a table-top source, which is believed to be currently possible (in terms of existing systems) only in a few synchrotron facilities, such as the ESRF-Facility in Grenoble at 100 ps time resolution.

Further, the final energy of the electron beam 28 can be pushed to over 70 MeV by adding a second accelerator module (after the first module 32 in the electron-beam path) to thereby generate x-rays with energy above 90 keV.

In describing embodiments of the invention, specific terminology is used for the sake of clarity. For purposes of description, each specific term is intended to at least include all technical and functional equivalents that operate in a similar manner to accomplish a similar purpose. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Moreover, while this invention has been shown and described with references to particular embodiments thereof, those skilled in the art will understand that various other changes in form and details may be made therein without departing from the scope of the invention.

What is claimed is:

1. A method for generating x-rays comprising:

generating a stream of electrons;

generating a stream of photons using a laser;

directing the stream of laser-generated photons into a passive enhancement cavity that includes optical elements defining a closed optical path in which the stream of laser-generated photons circulates, photons in the laser-generated stream being added coherently to photons already circulating in the closed optical path; and directing the accelerated electron stream into the passive enhancement cavity to generate x-rays via inverse-Compton scattering due to interaction of the electrons with the photons in the passive enhancement cavity.

2. The method of claim 1, wherein the photons are generated in pulses that are bunched into trains.

3. The method of claim 2, wherein the electrons are also generated in pulses that are bunched into trains.

4. The method of claim 3, wherein the time period separating electron pulses is a multiple of the time period for the photons' circulation in the closed optical path.

5. The method of claim 4, wherein the structure of the photon pulse trains is the same as that of the electron pulse train.

6. The method of claim 4, wherein the length of each electron pulse is 30 picoseconds or less.

7. The method of claim 6, wherein the electron pulse length is about 0.1 to about 1 picosecond.

8. The method of claim 7, wherein each electron pulse train comprises about 30 pulses of electrons.

9. The method of claim 8, wherein the electron pulse train has a frequency of about 3 kHz.

10. The method of claim 7, further comprising passing the x-rays through matter, detecting the x-rays after they pass through the matter, and evaluating the detected x-rays to monitor one or more dynamic processes relating to a chemical reaction, a condensed-matter phenomenon, or biological activity in the matter.

11. The method of claim 1, wherein the electrons are directed into the enhancement cavity at a frequency of about 10 MHz.

12. The method of claim 1, wherein the electrons are directed into the enhancement cavity at a frequency of about 10 Hz.

13. The method of claim 1, further comprising passing the x-rays through matter, detecting the x-rays after they pass through the matter, and evaluating the detected x-rays to image the matter via phase-contrast imaging.

14. The method of claim 1, wherein the x-rays are generated at a flux of at least about $10^9$ photons per second.

15. The method of claim 1, wherein the x-rays are emitted from a spot where photons collide with electrons having a cross-sectional area no larger than about 10 μm by about 10 μm.

16. The method of claim 1, farther comprising imaging a human with the generated x-rays in a hospital examination room.

17. The method of claim 1, further comprising accelerating the electron stream using a linear accelerator.

18. The method of claim 17, wherein the electron stream is generated using a radiofrequency photoinjector.

19. The method of claim 18, wherein the electron stream is generated by directing bunched pulses of photons against a cathode in the photoinjector.

20. The method of claim 19, wherein the pulse of photons directed against the photoinjector has a parabolic radial intensity profile and a temporal width of less than 500 femtoseconds fall width at half maximum.

21. The method of claim 19, wherein the pulse of photons directed against the photoinjector has a three-dimensional ellipsoid shape.

22. The method of claim 19, wherein the RF photoinjector is operated at a frequency of about 1.3 GHz.

23. The method of claim 18, wherein the RF photoinjector is operated at about 5 MeV or greater.

24. The method of claim 17, wherein the accelerator tunes the electron pulses by creating an energy chirp across each pulse to compress or stretch the electron pulses.

25. The method of claim 1, wherein the x-rays that are generated reach x-ray optics.

26. The method of claim 25, wherein the x-ray optics include a highly asymmetrical crystal pair with an asymmetry angle of 0.6 to 1.1 degrees less than the Bragg angle.

27. The method of claim 26, wherein the crystal pair comprises Ge(111), and wherein the x-rays are used to perform protein crystallography.

28. The method of claim 26, wherein the crystal pair comprises Si(111), and wherein the x-rays are used to perform multiple wavelength anomalous diffraction.

29. The method of claim 25, wherein the x-ray optics include reflective mirrors that decrease x-ray beam divergence while increasing beam size.

30. The method of claim 25, wherein the x-ray optics include multilayer optics that collect and collimate the x-rays.

31. A compact x-ray source comprising:

a radiofrequency photoinjector for generating electrons;

a radiofrequency linear accelerator configured to allow electrons generated by the radiofrequency photoinjector to pass through the accelerator; and an optical laser apparatus including a laser and a passive enhancement cavity, the passive enhancement cavity including a plurality of optical elements, wherein the optical elements are positioned to receive photons emitted by the laser and to circulate the photons in a closed optical path, and wherein the passive enhancement cavity is positioned to receive electrons that have passed through the accelerator such that the photons in the passive enhancement cavity interact with the electrons to produce x-rays via inverse-Compton scattering.

32. The compact x-ray source of claim 31, wherein the linear accelerator is a superconducting linear accelerator.

33. The compact x-ray source of claim 32, wherein the radiofrequency photoinjector comprises at least one accelerating cavity comprising a superconductor.

34. The compact x-ray source of claim 31, wherein the x-ray source occupies a floor space of no more than about 4 m by 6 m.

35. The compact x-ray source of claim 31, wherein the laser is a diode-pumped Yb:YAG laser or fiber laser.

* * * * *